United States Patent [19]

Levine

[11] Patent Number: 5,069,732

[45] Date of Patent: Dec. 3, 1991

[54] HAND-HELD LAMINATING ROLLER

[75] Inventor: Peter Levine, Pequannock, N.J.

[73] Assignee: Sabel, Inc., Pequannock, N.J.

[21] Appl. No.: 514,740

[22] Filed: Apr. 26, 1990

[51] Int. Cl.[5] ..... E04F 13/00

[52] U.S. Cl. ..... 156/71; 156/574; 156/579; 29/110.5; 29/116.1; 100/211; 81/489

[58] Field of Search ..... 156/579, 574, 71, 87; 29/110.5, 116.1, 125; 15/103.5, 230.11; 100/211; 144/346, 347, 348, 349, 350, 351; 81/489

[56] References Cited

U.S. PATENT DOCUMENTS

| | | | |
|---|---|---|---|
| 563,044 | 6/1896 | Lewis | 29/110.5 |
| 1,538,550 | 5/1925 | Hamilton | 29/116.1 X |
| 2,439,064 | 4/1948 | Sternad | 156/579 X |
| 4,479,842 | 10/1984 | Fujita | 156/579 X |
| 4,650,454 | 3/1987 | Moll | 29/125 X |
| 4,772,344 | 9/1988 | Andoe | 156/71 X |
| 4,814,227 | 3/1989 | Maeda et al. | 156/71 X |
| 4,934,024 | 6/1990 | Sexton, I | 81/489 X |

*Primary Examiner*—David A. Simmons
*Assistant Examiner*—J. Sells
*Attorney, Agent, or Firm*—Siegmar Silber

[57] ABSTRACT

A hand tool for applying pressure to plastic laminate material during the adhesion thereof to a suitable substrate. The device consists of a hard-rubber roller rotatably mounted within and extending beyond one corner of a pressure block. The block is adapted to fit the installer's hand so that the heel can be positioned over the corner adjacent the roller mounting corner of the roller while the installer's fingers can grip the remaining corner of the block.

16 Claims, 2 Drawing Sheets

HAND-HELD LAMINATING ROLLER

BACKGROUND OF THE INVENTION

1. Field of the Invention

The invention relates generally to a hand tool for applying pressure to surfaces, and more particularly to a novel and improved pressure roller device with manually controllable pressure characteristics. The hand tool generally used for laminating is adapted by the user to provide the desired results, and, with the roller pressed against the plastic laminate, the tool of this invention efficiently transmits pressure applied thereabove from the heel of user's hand through the pressure roller to the plastic laminate being applied.

2. Description of the Prior Art

In installation of plastic laminate, emphasis has been placed in recent years on newly developed adhesives and means of applying even pressure across the surface of the laminate. The most commonly used roller, popularly termed a "J-roller", provides a handle (similar to a paint-roller or ink-roller handle) which is at a right angle to the axis of the roller. A force vector, the size of which is determined by the angle between the handle and the workpiece, is representative of the downward pressure transmitted by the prior art roller. The prior conventional roller devices lose a substantial amount of applied pressure to the force vector parallel to the workpiece and thus do not provide the installer with a "feel" for the applied pressure.

While a brief review of collection of prior devices was made in the Official U.S. Patent Office Classification of Patents, particularly in Class 156, subclasses 73.6,200 and 579; Class 15, subclasses 103.5 and 230.11; Class 7, subclass 14.1A; and Class 29, subclasses 110.5 and 116, none of those found provided the control and efficiency of the present invention.

Exemplary of such devices are those taught in U.S. Pat. Nos. 3,641,643 to Niemi; 3,611,528 to Lance; 3,340,131 to Leibow; 2,335,624 to Weir; 1,637,450 to Martin and 1,433,576 to Utke.

A need exists for a simple and inexpensive pressure roller for laminating which provides the installer with a feeling for the amount of pressure applied. The pressure roller must provide even coverage for the laminate and have good maneuverability into corners and around edges.

SUMMARY OF THE INVENTION

The invention disclosed herein is a hand tool for applying pressure to plastic laminate material during the adhesion thereof to a suitable substrate. In the best mode of practicing the invention, the device consists of a hard-rubber-covered roller rotatably mounted on an axle within and extending radially beyond one corner of a pressure block. In the preferred embodiment, the roller assembly has an outer portion or roller cover which is pole cured onto the inner roller having a bearing surface in close tolerance with the axle. The block is adapted to fit the installer's hand and is dimensioned so that the heel of the installer's hand can be positioned over the corner adjacent the roller mounting corner while the installer's fingers can grip the remaining corners of the block. In this manner, substantially all the force applied to the tool can be used to provide pressure on the laminate.

It is the object of the invention to provide a pressure roller device for plastic laminating with superior pressure developing and maneuvering characteristics.

A further feature of the present invention provides a tool for plastic laminating having a structure enabling the installer to retain a feel for the amount of pressure applied thereby and to control the pressure applied.

Yet still further features of the invention is the provision of a pressure roller device for plastic laminating which is simple in its construction which may therefore be readily manufactured at low cost; and which, because of rugged and durable construction, will provide many years of usage to the installer in a maintenance-free manner which is well adapted for the application.

Other features of the invention will be apparent during the course of the following description.

BRIEF DESCRIPTION OF THE DRAWINGS

With the above and additional objects and advantages in view as will hereinafter appear, this invention comprises the device, combination and arrangement of parts hereinafter described and illustrated in the accompanying drawing of a preferred embodiment in which.

DESCRIPTION OF THE PREFERRED EMBODIMENT

Figure 1:
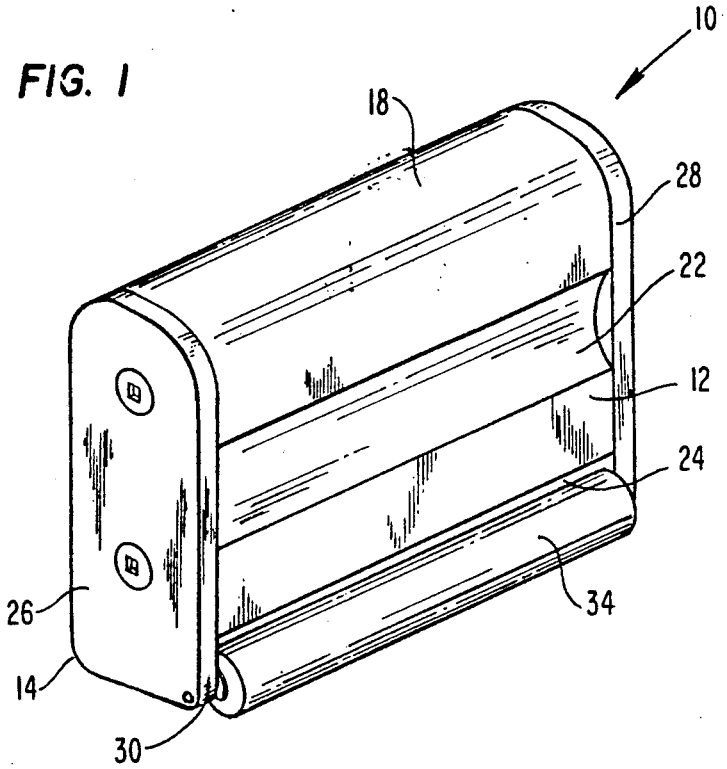
FIG. 1 is a perspective view of a hand tool of the present invention.
Figure 2:
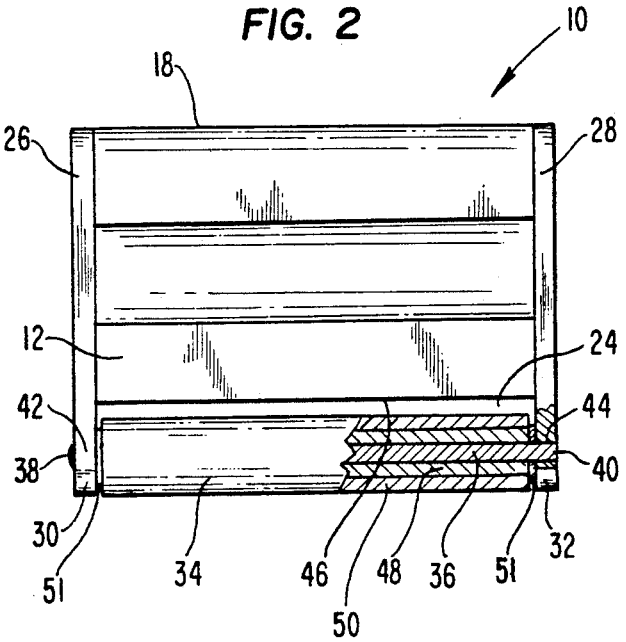
FIG. 2 is a elevational view of the hand tool shown in FIG. 1, and is partially broken away to illustrate the roller assembly construction.

Referring now to the drawings, and more particularly to FIGS. 1 through 4, the preferred embodiment of the present invention is shown and the pressure roller device for installation of plastic laminate thereof is referred to generally by the numeral 10.

A pressure block 12 which has two substantially flat faces 14 and 16 that are substantially parallel to one another. The pressure block 12 has a shaped front portion 18 and rear portion 20 with front portion 18 adapted to be conveniently grasped by the hand of the operator. The depression or finger groove 22 is provided adjacent front portion 18, fitted to receive the inner parts of the fingers of the operator's hand. A roller well or notched portion 24 is provided at the bottom of rear portion 20. Right side member 26 and left side member 28, structured as mirror images of one another and having inside contours substantially complimentary to the shape of the above mentioned portions 18 and 20, are fixedly attached to the side portions 26 and 28 of the block by means of screws or other fasteners in the usual manner. These side members or plates 26 and 28 extend beyond the sides of the pressure block 12 to enclose roller well 24. The bottom portions 30 and 32, respectively, house therebetween a cylindrical roller element 34. The roller 34 is shorter than the dimension of the width between the side members 26 and 28 and is rotatably mounted therebetween in any desired manner. In the best mode, the roller 34 is mounted, by means of axle or shaft 36 having the ends 38 and 40 thereof housed within respective side members 26 and 28. More specifically in the embodiment shown, a cylindrical roller element 34 is rotatably mounted to the pressure block 12 through the mounting of axle 36 which, in turn, is held fixedly captive by end housings 42 and 44. The housings are provided within side members 26 and 28 of the pressure block 12 and accommodate axially extending ends 38 and 40. Shaft end 38 is dimensioned to press fit securely within the respective housing 42, and shaft end 40 is dimensioned to seat within the respective housing 44. When viewed as used, the placement of housing 44 in the lowermost corner 46 of the side member 28 is arranged so that the roller element 34 extends radially rearward of rear portion 20 of the block and extends below the lower face 16 of the block 12.

Figure 3:
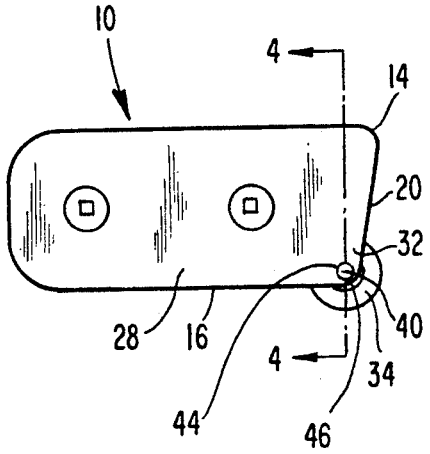
FIG. 3 is a side elevational view of the hand tool of FIG. 1.
Figure 4:
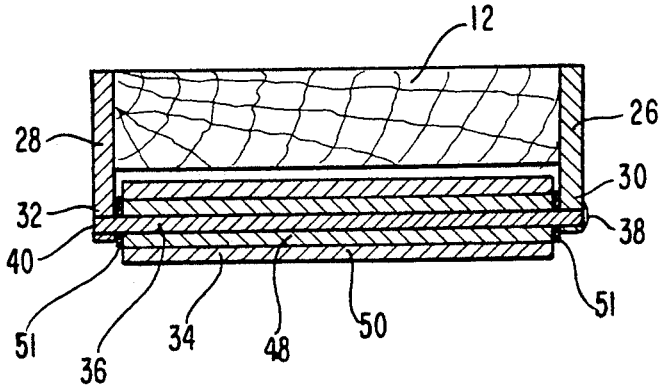
FIG. 4 is a cross-sectional view taken along line 4—4 of FIG. 3; and, FIG. 5 is a perspective view of the hand tool of this invention and is shown with the operator applying pressure to a laminar structure.

In the embodiment shown, a portion of the block adjacent lowermost corner 46 is cut away to provide a well or cavity 24 to house the balance of the roller 28. The side view of the tool is shown in FIG. 3 with the roller 34 mounted in the lower right corner. Preferably, for plastic laminating, the roller element 34 is constructed to include an inner roller portion 48 of a low-friction material and an outer roller portion 50 of a high-friction material. The inner roller portion 48 is constructed of a portion of tubing of a hard phenolic or other resinous material. The tubing is dimensioned to be closely sized to the shaft 36 and provides a continuous bearing surface along the length of the tubing. The outer roller portion or roller cover 50 is constructed of a hard rubber or other resilient material and, in the instant case, a hard rubber of 70 Durometer is used. The outer roller portion 50 is cured to the inner roller portion 48 by the process known as pole curing. To prevent end play, bushing 51 is placed between the roller element 34 ends and side members 26 and 28, respectively. Also, the top face 14 is extended rearwardly over the roller axle 36 giving a slightly canted appearance to the side view of the pressure block 12 and enabling the fullest application of pressure from the heel of the operator's hand. While the tool has been described in terms of its widest application, other roller styles may be employed for special applications. For example, for fine veneer work a solid, hard-rock maple roller in place of the two-part roller element 34 is employed, and for use with special adhesives a stainless steel outer roller portion 50 is employed with a suitable bearing insert 48 between the roller and the shaft.

The operation of the laminating tool or pressure roller 10 is next discussed. The laminate workpiece 52 is first adhered to the substrate 54 using a suitable adhesive layer 56.

Figure 5:
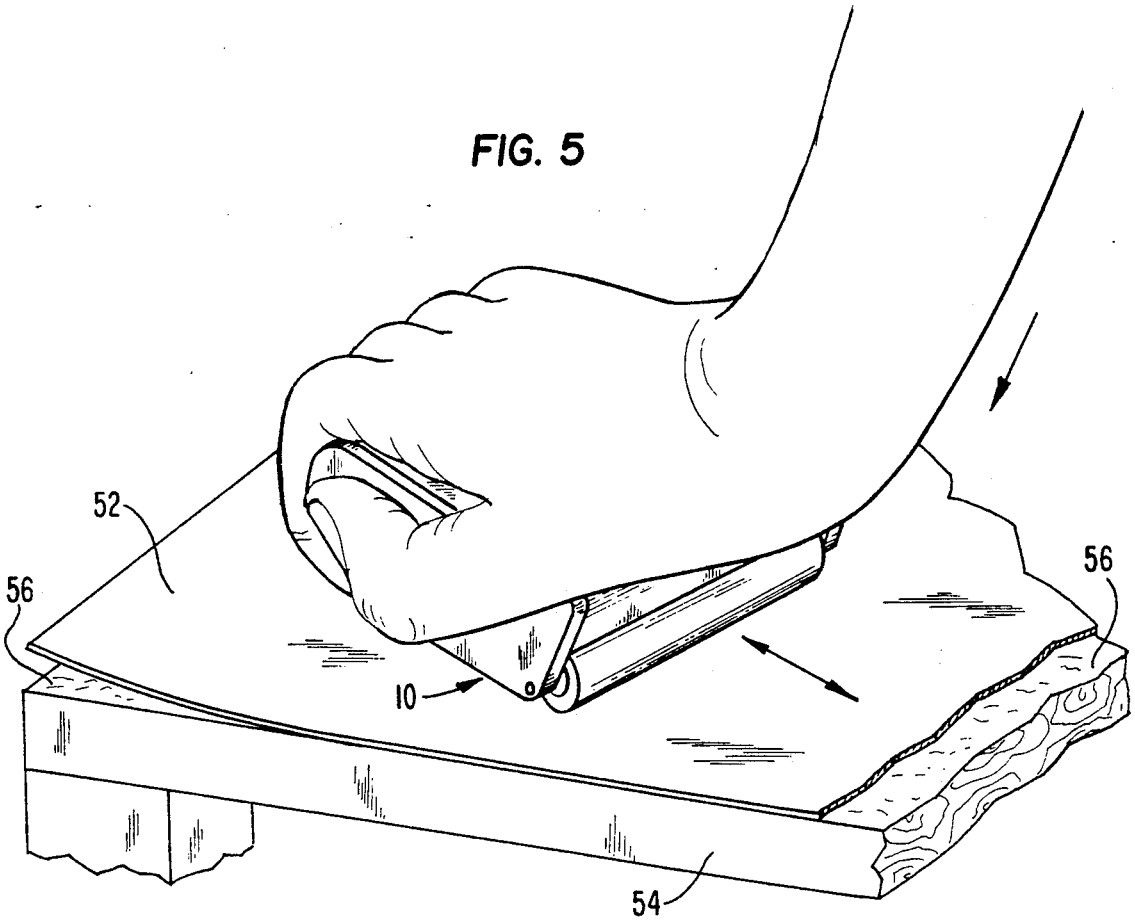

Referring now to FIG. 5, in using the tool, the operator grasps the tool 10 and presses the outer circumference of the roller element against the upper surface of the laminate 52. The operator holds the tool so that his forearm is substantially at a right angle to upper face portion 14 and the heel of his hand is over shaft 36 and resting on the rear portion 20 of face 14. The operator then causes the roller element 34 to roll against the laminate 52 and provides pressure for mounting the laminate 52 by moving the tool back and forth with the roller element 34 in contact with the laminate 52. Because the geometry of the laminating tool 10 permits a very high efficiency of pressure delivery, that is the pressure exerted, is substantially equivalent to pressure provided, the laminating operator can quickly develop a "feel" for the pressure-to-be-used and, conversely, can more readily determine the point at which the lamination process has been successfully completed. With the prior art J-roller, by contrast, the completion point frequently eludes the operator.

Upon using the tool described in application, the adequate pressure with minimum loss will be applied to provide intimate contact between the laminate and the substrate involved in the installation. Furthermore, proper adhesion therebetween is assured, and the installer retains a "feel" for the amount of and the control of the pressure applied.

In operating with the laminating tool of this invention a method of applying a laminar structure to a substrate is employed. The method uses a laminating tool having a hand-conforming pressure block, including a forward edge and a heelplate on the upper surface, and a roller mounted within a notched corner below the heelplate. In the form of method steps, it is first described as one which employs a known bonding process. The method of this invention comprises the steps of:

(a) preparing the substrate to receive the laminar structure in accordance with the bonding process employed; and optionally includes the following substeps:
  (1) removing all dust and grease from the mating surface of the substrate;
  (2) spreading an even and thin coat of adhesive over the mating surface;
(b) carefully positioning the laminar structure on the suitably prepared said substrate while maintaining registrations, if any, between the mating surfaces thereof;
(c) gripping the tool about the forward edge while placing the heel of the hand on the heelplate of the upper surface of the laminating tool and above the roller;
(d) exerting pressure on the non-mating surface of the laminar structure with the forearm of the user's arm as close to normal to the surface of the laminar structure as feasible; and, optionally includes the substeps of:
  (1) working the tool to and fro from the centermost area of the non-mating surface of the laminar structure to the outer areas thereof; and,
  (2) expressing air from between the surfaces being bonded; and,
(e) securely seating the laminar structure onto the substrate.

Additionally with the laminating tool of this invention, a method of applying a laminar structure to a substrate is employed as described hereinabove. However, the tool further includes a nose portion curved to fit the interior of the partially closed hand of a user and the upper face of the pressure block extends rearwardly above and slightly beyond the notched corner housing the roller. The method includes the following steps:

(a) preparing the substrate to receive the laminar structure in accordance with the bonding process employed;
(b) carefully positioning the laminar structure on the suitably prepared said substrate while maintaining registrations, if any, between the mating surfaces thereof;
(c) gripping the tool about the forward edge while placing the heel of the hand on the heelplate of the upper surface of the laminating tool and above the roller; and, optionally includes the substeps of:
  (1) wrapping the user's fingers about the nose portion of the laminating tool to fit said nose portion within the interior area of the user's hand, said area located between adjacent interphalangeal joints and between the second interphalangeal joint and the phalangeal/metacarpal joint; and, (2) positioning the heel of the user's hand on the extended portion of the pressure block; and, (d) exerting pressure on the non-mating surface of the laminar structure with the forearm of the user's arm as close to normal to the surface of the laminar structure as feasible;

Although the present invention has been described with reference to particularly embodiment and examples, it will be apparent to those skilled in the art that variations and modifications can be substituted therefore without departing from principles and true spirit of the invention. The abstract given herewith is for the convenience of technical searches and is not for the interpretation of the scope of the invention.

What is claimed is:

1. A hand tool for the application of pressure by a user to the surface of a laminar structure during the mounting thereof to a substrate, said hand tool comprising, in combination:

a pressure block with a notched corner, said pressure block, in turn, further comprising:

a base portion having substantially parallel upper and lower faces and dimensioned to fit the hand of the user, said lower face extending to said notched corner, said base portion, in turn further comprising;

groove means for accommodating, when the tool is grasped by the user, the fingertips of the user, said groove means situated in the lower face of the pressure block and substantially parallel to said shaft;

a pair of side plate portions, one on each side of said base portion, with one of the pair being the mirror image of the other, each having in a corresponding corner thereof an opening therein to receive one end of a shaft, said side plate portions arranged to extend beyond the side of the base portion and to have the shaft opening coincident with the notched corner of the pressure block;

a shaft adapted to be fixedly captive within said shaft openings in said side plate portions and to be housed within the notched corner of said pressure block; and, a tubular roller of a first material mounted coaxially with and rotatably about said shaft and extending substantially along the exposed length of the captive shaft;

whereby, while mounting a laminar structure to a substrate, with the user's hand about the pressure block and the heel of his hand above the roller, pressure is provided by the user pushing the roller cover against the surface of the laminar structure.

2. A hand tool as described in claim 1, wherein said base portion further comprises a nose portion curved to fit the interior of the partially closed hand of a user, said nose portion extending between the upper and lower faces at the end opposite the shaft housing.

3. A hand tool as described in claim 2, wherein said nose portion is curved to fit the interior area of the user's hand between adjacent interphalangeal joints and between the second interphalangeal joint and the phalangeal/metacarpal joint.

4. A hand tool as described in claim 1, wherein said upper face of said base portion extends rearwardly above and slightly beyond the notched corner housing said roller and thereby enhancing the application of pressure to the laminar structure.

5. A hand tool as described in claim 1, wherein said roller further comprises a roller cover of a second material mounted coaxially with and adhered to said tubular roller and being substantially co-extensive therewith.

6. A hand tool as described in claim 5, wherein said first material is a low-friction material and said second material is a high-friction material.

7. A hand tool as described in claim 6, wherein said high-friction material is hard rubber of 70 Durometer.

8. A hand tool as described in claim 6, wherein said hand tool further comprises bushing means for spacing the high-friction material of the roller cover from the side portions, said bushings being flat washers of low-friction material and having an outer diameter less than that of said tubular roller.

9. A hand tool for the application of pressure by a user to the surface of a laminar structure during the mounting thereof to a substrate, said hand tool comprising, in combination:

a pair of mounting plates with one of the pair being the mirror image of the other, each having in a corresponding corner thereof an opening therein to receive one end of a shaft;

a pressure block having a notched corner, said pressure block having substantially parallel upper and lower faces and dimensioned to fit the hand of the user, said pressure block attachable to said mounting plates with one of the mounting plates fitting to each side of the pressure block, each said mounting plate when mounted to said pressure block with said lower face extending to the notched corner and arranged to extend beyond the side of the pressure block and to have the shaft opening coincident with the notched corner;

said pressure block, in turn further comprising:

groove means for accommodating, when the tool is grasped by the user, the fingertips of the user, said grove means situated in the lower face of the pressure block;

a shaft adapted, when the mounting plates are attached to said pressure block, to be fixedly captive within said shaft openings in said mounting plates and to be housed within the notched portion of said pressure block;

a tubular roller of a low-friction material mounted coaxially with and rotatably about said shaft and extending, when the mounting plates are attached to said pressure block, substantially along the exposed length of the captive shaft; and, a roller cover of a high-friction material mounted coaxially with and adhered to said tubular roller and being substantially coextensive therewith;

whereby, while mounting a laminar structure to a substrate, with the user's hand about the pressure block and the heel of his hand above the roller, pressure is provided by the user pushing the roller cover against the surface of the laminar structure.

10. A hand tool as described in claim 9, wherein said pressure block further comprises a nose portion curved to fit the interior of the partially closed hand of a user, said nose portion extending between the upper and lower faces at the end opposite the shaft housing.

11. A hand tool as described in claim 10, wherein said nose portion is curved to fit the interior area of the user's hand located between adjacent interphalangeal joints and between the second interphalangeal joint and the phalangeal/metacarpal joint.

12. A hand tool as described in claim 9, wherein said upper face of said pressure block extends rearwardly above and slightly beyond the notched corner housing said roller and thereby enhances the application of pressure to the laminar structure.

13. A hand tool as described in claim 9, wherein said hand tool further comprises bushing means for spacing the high-friction material of the roller cover from the mounting plates, said bushings being flat washers of low-friction material and having an outer diameter less than that of said tubular roller.

14. A method of applying a laminar structure to a substrate using a laminating tool having a hand-conforming pressure block, including a forward edge and a heelplate on the upper surface, and a roller mounted within a notched corner below the heelplate, said method employing a known bonding process and comprising the steps of:

(a) preparing said substrate to receive said laminar structure in accordance with the bonding process employed;

(b) carefully positioning said laminar structure on the suitably prepared said substrate while maintaining registrations, if any, between the mating surfaces thereof;

(c) gripping the tool about the forward edge while placing the heel of the hand on the heelplate of the upper surface of the laminating tool and above the roller;

(d) exerting pressure on the non-mating surface of the laminar structure with the forearm of the user's arm as close to normal to the surface of the laminar structure as feasible; and, (e) securely seating the laminar structure onto the substrate.

15. A method of applying a laminar structure to a substrate as described in claim 14, wherein the method includes the following substeps:

in step (a), (1) removing all dust and grease from the mating surface of the substrate;

(2) spreading an even and thin coat of adhesive over the mating surface;

in step (d), (1) working the tool to and fro from the centermost area of the non-mating surface of the laminar structure to the outer areas thereof; and, (2) expressing air from between the surfaces being bonded.

16. A method of applying a laminar structure to a substrate as described in claim 14, wherein the tool further includes a nose portion curved to fit the interior of the partially closed hand of a user and the upper face of said pressure block extends rearwardly above and slightly beyond the notched corner housing said roller, and wherein a method includes the following substeps:

in step c, (1) wrapping the user's fingers about the nose portion of the laminating tool to fit said nose portion within the interior area of the user's hand, said area located between adjacent interphalangeal joints and between the second interphalangeal joint and the phalangeal/metacarpal joint; and, (2) positioning the heel of the user's hand on the extended portion of the pressure block.

* * * * *